US011361739B2

(12) United States Patent
Lauermann

(10) Patent No.: US 11,361,739 B2
(45) Date of Patent: Jun. 14, 2022

(54) PRECISION REED MADE OF WOOD OR ARUNDO DONAX

(71) Applicant: Walter Lauermann, Unterpleichfeld (DE)

(72) Inventor: Walter Lauermann, Unterpleichfeld (DE)

( * ) Notice: Subject to any disclaimer, the term of this patent is extended or adjusted under 35 U.S.C. 154(b) by 0 days.

(21) Appl. No.: 17/188,657

(22) Filed: Mar. 1, 2021

(65) Prior Publication Data

US 2021/0287636 A1 Sep. 16, 2021

(30) Foreign Application Priority Data

Mar. 10, 2020 (DE) ..... 10 2020 106 417.9

(51) Int. Cl.
*G10D 9/035* (2020.01)

(52) U.S. Cl.
CPC ..... *G10D 9/035* (2020.02)

(58) Field of Classification Search
CPC ..... G10D 9/035; G10D 9/02; G10D 9/00
See application file for complete search history.

(56) References Cited

U.S. PATENT DOCUMENTS

| | | | | |
|---|---|---|---|---|
| 4,056,997 | A | 11/1977 | Rovner | |
| 2009/0217799 | A1* | 9/2009 | Rovner | G10D 9/02 84/383 R |
| 2021/0193090 | A1* | 6/2021 | Tzeng | G10D 7/06 |

FOREIGN PATENT DOCUMENTS

| | | | |
|---|---|---|---|
| DE | 10 2006 018 586 | A1 | 5/2007 |
| DE | 20 2007 004 029 | U1 | 7/2007 |
| EP | 0 189 223 | A2 | 7/1986 |
| FR | 567 568 | A | 3/1924 |

* cited by examiner

*Primary Examiner* — Kimberly R Lockett
(74) *Attorney, Agent, or Firm* — Frank H. Foster; Kremblas & Foster

(57) ABSTRACT

The invention relates to a precision reed (100) for single-reed instruments such as the clarinet or saxophone, made of wood or an Arundo donax section, having a vibrating section (120) formed for sound generating by means of an air flow in the single-reed instrument, having a clamping section (110) formed for clamping the reed (100) to the mouthpiece (200) with a reed holder, the clamping section (110) having a support wall (104) for supporting the reed (100) on the mouthpiece (200) and a reed back (111) facing away from of the mouthpiece (200). In this case, the reed back (111) is formed for a fully flat contact with the reed holder.

11 Claims, 3 Drawing Sheets

PRECISION REED MADE OF WOOD OR ARUNDO DONAX

BACKGROUND OF THE INVENTION

The invention relates to a reed for reed instruments such as the clarinet or saxophone, made of wood or an Arundo donax section, according to the preamble of claim 1.

The invention also relates to a method for producing a reed for reed instruments such as the clarinet or saxophone, according to the preamble of claim 7.

Reeds are used in many wind instruments to generate the sound. They form the vibrating part of the instrument mouthpiece. Most of the reeds are made of Arundo donax or common reed, Latin name ARUNDO DONAX Linneus, but also of other natural or synthetic materials. The following patent application relates to reeds made of wood, in particular giant reed. Modern single-reed instruments such as the clarinet or saxophone usually have a flat reed that is attached to a mouthpiece and can be separated from it. The reed is attached to an opening of the mouthpiece so that it can easily protrude beyond the edge of the opening and closes it except for an air gap, so that a stream of air causes the reed to vibrate.

A reed blank 105 from the prior art according to FIGS. 1*a* and 3*a* is formed essentially symmetrically with respect to a longitudinal axis or axis of symmetry 103 and has a support wall 104 for support on a table 201 of the mouthpiece 200 (cf. FIG. 3*a*) of the single-reed instrument. The reed 105 can be divided approximately in half along a transverse line drawn in dashed lines into a clamping section 110 and a vibrating section 120. By a reed holder, for example by a ligature or cord (not shown) a compressive force 202 is exerted on the reed back 111 in the clamping section 110 which presses the reed 105 at its support wall 104 against the table 201 of the mouthpiece 200. The vibrating section 120 is placed in the mouth of a musician for making music and has a sanded back area, the cutout 121 (also called "cut" or "bleed" called), so that the reed 105 can oscillate elastically due to an air flow. To produce the cutout 121, the reed 105 is ground thin towards the front edge 101. The cutout 121, in turn, can be divided into the blade tip 124, heart 123 and flanks 122. The reed back 111 has the unmachined reed bark 113 of the common reed and is therefore formed as a natural product with unevenness 112.

Reeds are essential to sound quality. That is why one has always tried to optimize the reeds. Reeds made of common reed are a natural product, so each reed is distinct. Whether a reed is able to provide desired vibration properties depends primarily on the growth of the reed, i.e. on the uniform fiber orientation within the reed blank. A fast-growing common reed means a large-pored structure, while a slowly growing common reed has a dense structure. Only in the last working step, the cutout, it can be seen, whether the finished reed has the desired uniform fiber orientation or not.

The experience of musicians in dealing with reeds shows that often new reeds with an apparently wonderfully "even fiber orientation" still do not sound nice or do not convey a pleasant playing feeling. Professional musicians in particular cannot use such faulty reeds and have to check all the reeds they buy and in some cases discard them. Up to 80% of all reeds purchased must be disposed of, which increases the operating costs for musicians, especially for professional musicians.

In the prior art, the optimization of the geometric shape of the cutout and the optimization of the geometric shape of the facing on the mouthpiece are already generally known (see, for example, http://www.tittmann.de/SaxophonShop/Mundstueck-Tips::16.html, accessed on Mar. 4, 2020). In particular, the clamping section of the reed offers still room for improvement.

FR 567.568 A relates to a reed made of common reed, in which the clamping area has grooves in the longitudinal direction and in the transverse direction in order to improve the vibration quality. FR 653 293 A also shows a reed made of common reed, in which the shaft for improving the vibration quality is notched over a large area such that two crosspieces for the formation of the clamping contacts with the ligature remain. FR 700.943 A relates to a reed made of common reed, in which the clamping area is machined at the bottom to improve durability. For this purpose, a recess is arranged at the bottom, into which a soft rubber insert is inserted.

FR 1.034.410 A discloses a reed made of wood with a completely machined shaft. The shaft is split lengthways, with the split halves being reworked by grinding so that a semicircular contour results for each split half. The gap and the gap halves prevent the reed from warping, which means that the reed can also be used without restrictions in a damp environment.

The clamping areas shown in the prior art must be produced in a very complex manner. Due to the substantial material removal the vibrating section of the reed is negatively impacted. The backbone and the heart of the reed are altered and thus the playability and the sound are negatively impacted.

It is the object of the present invention to eliminate the disadvantages of the prior art and to provide an improved reed which better compensates the disadvantages of wood as a natural product and maintains its sound quality even in a damp environment.

SUMMARY OF THE INVENTION

The object is achieved by a reed according to claim 1 and a method for producing a reed according to claim 7. Advantageous embodiments are claimed in the dependent claims and are explained in more detail below. For the sake of clarity, reeds from the prior art with unmachined reed back or other intermediate products in the production of a reed are referred to as "reed blank" in this application, while the product according to the invention is referred to as "reed".

The invention relates to a reed for reed instruments such as the clarinet or saxophone, made of wood or an Arundo donax section. The reed has a vibrating section which is formed to generate sound by means of an air flow in the single-reed instrument. The reed further comprises a clamping section formed for clamping the reed to the mouthpiece with a reed holder, also known as ligature. Here, the clamping section also has a support wall for supporting the reed on the mouthpiece and a reed back facing away from the mouthpiece, the reed back being formed for a fully flat contact with the reed holder.

The machining of the reed back is carried out in such a manner that a cross section of the clamping section is formed with a symmetry in relation to an axis of symmetry which is perpendicular to the support wall.

The invention solves the problem that the unmachined reed back of a reed blank as a natural product has unevenness which would prevent a fully flat contact on the reed holder. Rather, the unevenness prevents an even distribution of the compressive force of the reed holder on the reed back of a reed blank, so that the surface pressure between the support wall and the mouthpiece is not evenly distributed. In the case of reed blanks according to the prior art, reeds are precisely machined on all sides, while the back of the reed remains unmachined. This is often not possible in any other way, because tool gauges for the production of reeds hold the reed blank clamped on the reed back while the vibrating section or the support wall of the reed is cut. The reed back is therefore not accessible during production, which is why its machining is impractical. The invention allows a so-called "precision reed" to be made available from these reed blanks by re-machining the natural reed back so that each product according to the invention brings exactly the same dimensional requirements for clamping to a mouthpiece. As an alternative to re-machining of the reed back, the still cylindrical common reed section designated for machining, in a first working step, can be brought to a predetermined outer diameter by machining on the outside. In this way too, the reed bark would then be completely or partially removed. All other working steps for the production of a reed (e.g., splitting the cylindrical section, cutout, support wall) could then proceed in the same or the desired sequence. The result would then also be an exact "precision" reed according to the invention. A deviation, especially a deviation with an angle of 1-5°, of the parallelism of the reed back with respect to the support wall in the longitudinal direction does not negatively impact the uniform distribution of the compressive force of the reed holder on the reed.

As is well known in the art, the vibrating sections can, depending on the reed type, vary in shape. The intended machining of the reed back ensures that the sound characteristics of the various reed types are not affected. The formation of the reed back for fully flat and/or full-surface contact with the reed holder, in particular with a ligature is achieved by eliminating unevenness which can be found on a reed with an unmachined reed back. The radius of curvature or outer radius of the "precision" reed back preferably corresponds to a radius or inner radius of a pressure plate or a receiving shoe of a pre-specified reed holder. In this way, a uniform distribution of the compressive force of the reed holder on the reed back can be achieved, so that the surface pressure between the support wall 104 and the mouthpiece 200 is evenly distributed. In this way, any unwanted vibration is prevented in the clamping section and the sound that is affected by the vibrating section will remain unaltered.

In an optional, but particularly economical embodiment, a machining of the reed back is carried out in such a manner that, in the longitudinal direction, a parallel or exact parallel to the support wall is formed.

Technically, this embodiment can be produced particularly easily and is therefore particularly advantageous from an economic perspective.

In a preferred embodiment, the reed back is machined for a fully flat contact with the reed holder.

In other words, the unevenness of the reed back of a reed blank is removed, for example, with sandpaper or a horsetail until the reed back is leveled according to the desired outer radius or radius of curvature of the reed back. In principle, all tools, devices and machines that are known for machining reeds are suitable for machining.

The back of the reed is preferably formed as a wall of the clamping section with a convex curvature.

In other words, the reed has a longitudinal axis and/or an axis of symmetry and a cross section in the clamping section that is perpendicular to this longitudinal axis and/or axis of symmetry, has a convex outer curvature. By maintaining the convex outer curvature (cf. also FIG. 2), the stability of the reed can also be ensured by re-machining the clamping section. The vibration area, in particular the heart of the cutout, is not affected by the machining of the clamping section and the sound quality intended with the design of the cutout is retained.

Particularly preferably, the reed is obtained by providing a reed blank made of wood or an Arundo donax section, the reed blank comprising at least an unmachined and/or natural surface with a reed bark, and by forming the reed back of the reed by at least partial removal of the reed bark.

This solves the problem that uneven swelling of the reed in a damp environment degrades the sound quality. The professional world recommends that musicians should first play a new reed two to three times for about 10 minutes at intervals of 12-24 hours, in order to then decide whether a reed meets the requirements for good sound quality. Proven by measurements, a newly-established reed is acceptable if, after the two to three phases of moistening and drying, it has warped only slightly, that is, that the reed—with different ligatures—can be clamped to the mouthpiece acceptably and continues to sound good. By at least partial removal of the reed bark from the reed back by machining the "raw reed blank" into the precision reed, the surprisingly positive effect of the more uniform swelling property of the reed during the period of use results. The reed gains flexibility due to the—even partial—removal of the reed bark. The support wall 104 of the reed clings fully and full-surface to the table of the mouthpiece in particular when it absorbs moisture during playing. Due to the full-surface support on the mouthpiece, the evenly acting clamping force is ensured by the reed holder, so that the reed can definitely only vibrate in the specially formed vibration area. The preferred design of at least partially freeing the reed back from the reed bark which acts like a clamp, causes the wood body to swell uniformly. When the reed is clamped onto the mouthpiece again, almost every reed holder is able to clamp the now more elastic "wood body" onto the table of the mouthpiece with uniform surface pressure.

Preferably, the reed is obtained by forming the reed back by completely removing the reed bark. By completely removing the reed bark a particularly uniform swelling and drying of the reed is achieved. The reed that has been machined remains playable throughout its entire period of use.

Independent protection of inventions is claimed for a method for producing a reed for reed instruments such as the clarinet or saxophone, the method comprising the following steps:

- providing a reed blank made of wood or an Arundo donax section,
- forming a support wall for supporting the reed on the mouthpiece,
- generating a vibrating section by forming a cutout,
- generating the clamping section by machining the reed back, the reed back forming a parallel to the support wall in the longitudinal direction (see, e.g., FIG. 1*b* axis of symmetry 103) and forming, in the cross section of the clamping area (see, e.g., FIG. 3*b*), a symmetry in relation to an axis of symmetry which is perpendicular to the support wall and/or by forming a reed back for a fully flat contact between the reed back and the reed holder.

It should be understood that the aforementioned method steps can be carried out in any order. Instead of a re-machining of the reed back, a method according to the invention can therefore also be configured such that the still cylindrical common reed section designated for machining, in a first working step, is brought to a predetermined outer diameter by machining on the outside. In this way too, the reed bark would then be completely or partially removed. All other working steps for making a reed (e.g. cutout, support wall) could then follow in unchanged or desired sequence. The result would then also be an exact "precision" reed according to the invention.

The formation of a reed back is preferably carried out by means of machining, for example with sandpaper or horsetail or suitable devices during machining on suitable machines.

Optionally, when forming the reed back, the reed bark is removed completely or at least partially.

Further details, features, (sub)combinations of features, advantages and effects based on the invention become apparent from the following description of a preferred exemplary embodiment of the invention and the drawings.

BRIEF DESCRIPTION OF THE SEVERAL VIEWS OF THE DRAWINGS

The figures are merely exemplary in nature and are only used to promote understanding the invention. Same elements are provided with the same reference numerals.

DETAILED DESCRIPTION OF THE INVENTION

Figure 1A:
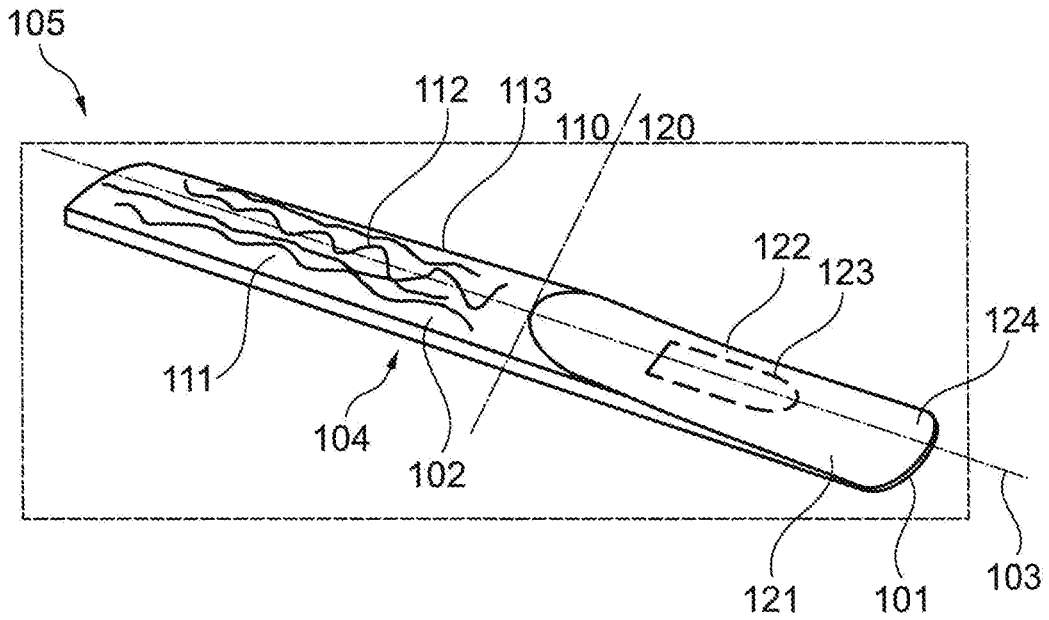
Fig. 1a PRIOR ART
FIG. 1*a* shows a reed blank or a reed from the prior art in a perspective illustration.

FIG. 1*a* shows a reed blank 105, in which the reed leading edge 101, the side walls 102, the support wall 104 and the cutout 121 are very precisely cut depending on the desired type, while the clamping section 110 of the reed blank 105, in particular the reed back 111, is left natural. It is well known that in nature there is neither a right angle nor exactly flat surfaces or even symmetrical radii. As a result of the reed bark 113, unevenness 112 is present on the unmachined reed back 111, both in the longitudinal and in the transverse direction. Originally, the reeds 105 were tied to the mouthpiece 200 (see FIG. 3*a*) using a fine cord. Traditionalists "wrap" to this day. This type of attachment levels most effectively any unevenness 112 of the reed back 111. That is why the machining of the reed back 111 was considered not to be necessary at the time.

Figure 1B:
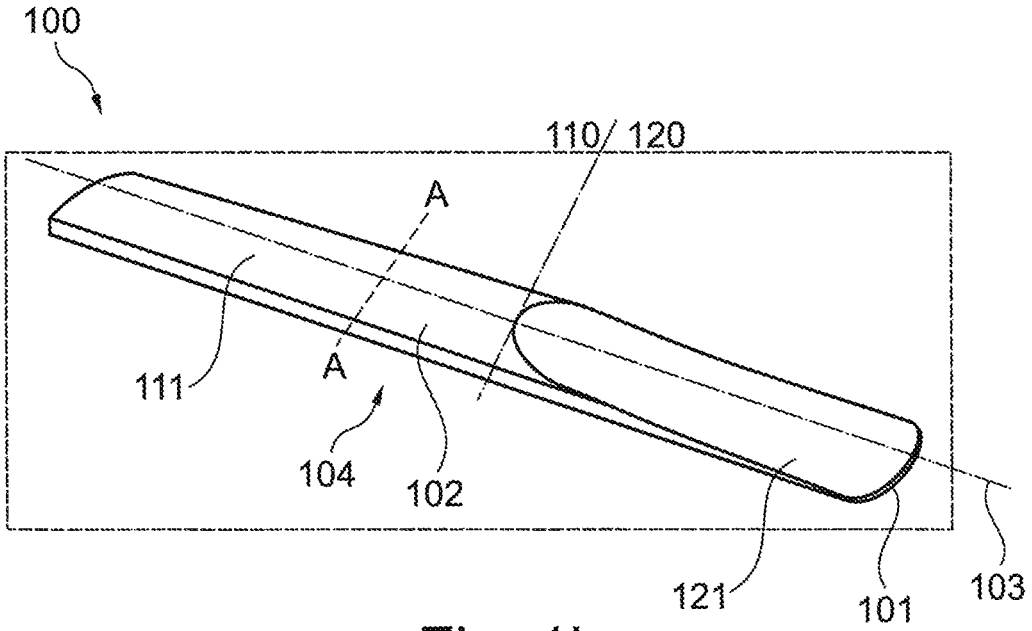
FIG. 1*b* shows a reed in an exemplary embodiment of the invention in a perspective illustration.

FIG. 1*b* enables as a precision reed 100 through the machining of the reed back 111, that is to say, a complete machining of the reed, its fully flat contact with pressure plates, receiving shoes or other clamping devices of reed holders. The slight re-machining or thin-walled removal of the reed back 111 prevents undesired interventions in the heart 123 (cf. FIG. 1*a*) or the backbone. The convex bulge of the reed back 111 is also retained for the precision reed 100.

Figure 2:
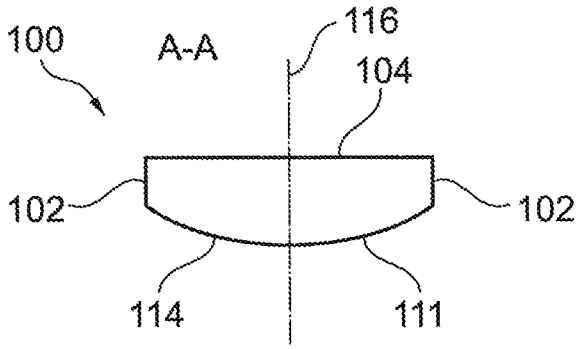
FIG. 2 shows a reed in an exemplary embodiment of the invention in a sectional illustration.

FIG. 2 shows a section along line A-A in FIG. 1*b* in the clamping section 110. The cross section is delimited by the support wall 104, the side walls 102 and the reed back 111 with a convex curvature 114, so that a convex cross section is formed. The reed back 111 is machined in such a way that both in the longitudinal direction (see also FIG. 1*a* and FIG. 1*b* axis of symmetry 103) an exact parallel to the support wall 104 is formed, as well as in the cross section of the clamping section 110 (see FIG. 3*b*) an exact symmetry in relation to an axis of symmetry 116 which is perpendicular to the support wall 104 is formed.

Figure 3A:
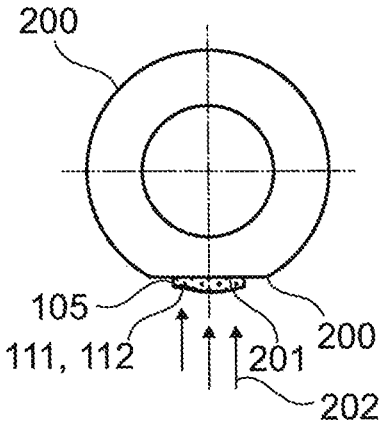
PRIOR ART Fig. 3a
FIG. 3*a* shows a schematic diagram of a reed blank or a reed from the prior art on a mouthpiece 200.

FIG. 3*a* shows a reed blank 105 having a reed back 111, which as a natural product has unevenness 112. The compressive force 202, which the reed holder (not shown) generates for pressing the reed 105, can act only unevenly on the reed back 111 due to the uneven shape of the reed back 111. The surface pressure between support wall 104 and the table 201 of the mouthpiece 200 is therefore not uniform and very low in some areas. As a result, the reed 105 can partially co-vibrate when the vibrating section 120 vibrates. In order not to distort the sound characteristics of the cutout 121, the part of the reed 105 clamped to the table 201 of the mouthpiece 200—that is to say the clamping section 110, however, must not co-vibrate, not even partially. The reed holder can only clamp a reed 100, 105 with a uniform surface pressure to a mouthpiece 200 if the clamping section 110 of the reed 105 allows this uniform surface pressure at all. This requirement is not met in natural reed backs 111. According to the prior art, the compressive force 202 is different from reed blank 105 to reed blank 105, i.e. distributed non-uniformly over the support surface 104.

Figure 3B:
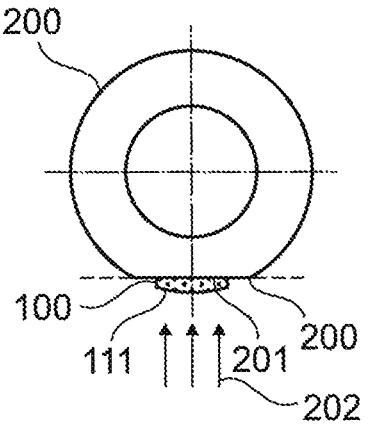
FIG. 3*b* is a schematic diagram of a reed in an exemplary embodiment of the invention on a mouthpiece 200.

FIG. 3*b* shows a precision reed 100, in which the natural reed back 111 with unevenness 112, is re-machined, preferably slightly, such that there are exactly the same dimensional conditions for clamping the precision reed 100 to a mouthpiece 200. The re-machining of the precision reed 100 in the clamping section 110 ensures that the characteristics of the various types of reed are not affected because the sound characteristics of a reed 100, 105 is to be determined solely by the cutout 121. Re-machining is therefore only carried out in the clamping section 110.

Figure 4A:
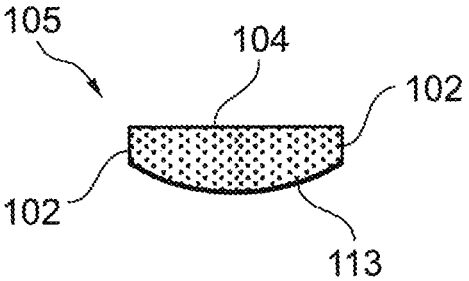
PRIOR ART Fig. 4a
FIG. 4*a* shows a schematic diagram of a reed blank or a reed from the prior art with reed bark in a dry environment.

FIG. 4*a* shows a sectional view through a reed blank 105, the porosity of the reed being indicated by dots in the sectional illustration, while the reed bark is shown as a bold line 113. Each time the reed 105 is used, it absorbs condensation or saliva. The capillary action also transports the moisture along the fiber orientation into the rear clamping section 110. The reed bark 113 is formed to be water-repellent on the outside, so that the moisture cannot escape the reed bark 113 as a result of the swelling process.

Figure 4B:
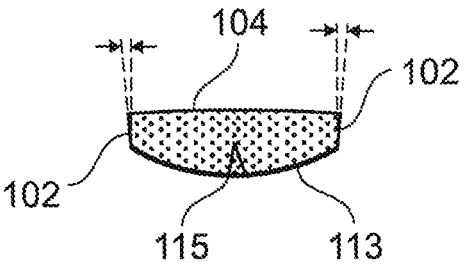
PRIOR ART Fig. 4b
FIG. 4*b* shows a schematic diagram of a reed/reed blank after the swelling process with reed bark in a moist environment.

FIG. 4*b* shows the swelling of the reed 105 by the moisture. The hard reed bark 113 acts like a clamp on the reed back 112 and does not give in to the swelling process, so that the volume expansion can only be seen on the machined side walls 102 and the support wall 104. In all reed blanks 105 with reed bark 113 on the reed back 111 the swelling of the reed causes a visible and measurable bulge of the support wall 104. The contact to the table 201 is no longer full and full-surface. Thus, the clamping section can partially co-vibrate again (as described above). As the playing time increases, the sound quality deteriorates. By machining the reed back 111, a more uniform swelling of the reed 105 can be realized. A single dehumidification groove 115 formed as a longitudinal groove cancels the clamping effect of the reed bark 113 and causes a uniform swelling in all directions. Therefore, a plurality of dehumidifying grooves 115 can be arranged distributed along the reed back 111 as longitudinal or transverse grooves, with the result that the reed bark 113 is partially removed and a more uniform swelling of the reed 105 is achieved. A uniform clamping force distribution during further use cannot be achieved by dehumidifying grooves 115 alone. Only through the complete machining of the clamping section 110 of the reed 100 according to the invention can a uniform clamping force distribution be achieved and thus an unrestricted permanent use of the reed 100 ensured.

Figure 5A:
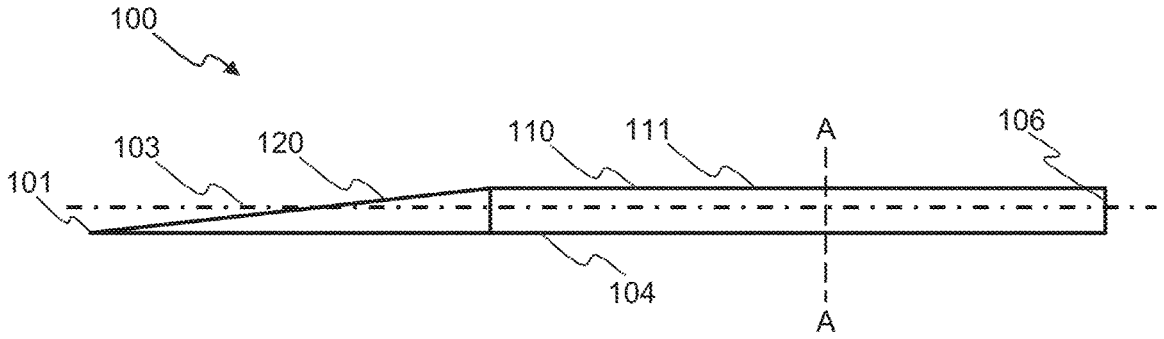
FIGS. 5*a*-5*c* show a schematic diagram (side view) of a reed in an exemplary embodiment of the invention.
Figure 5B:
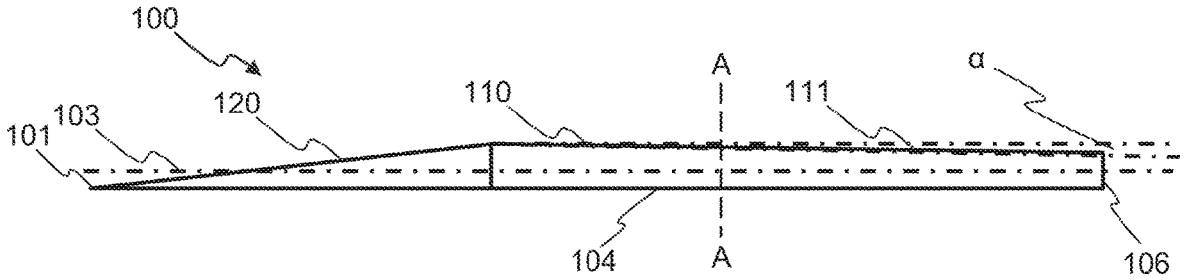
Figure 5C:
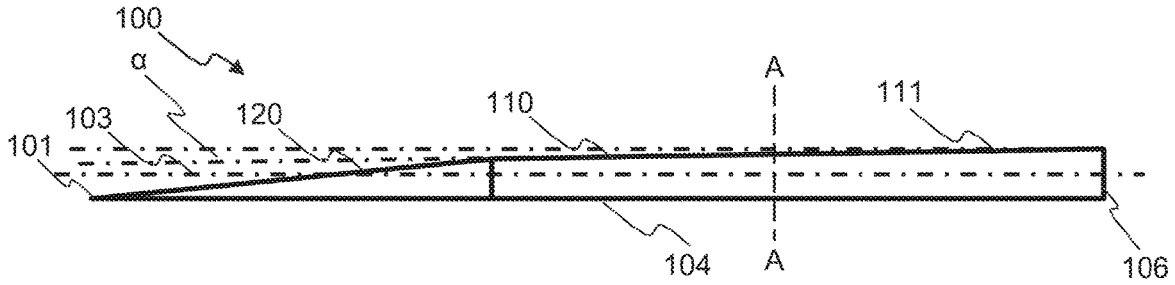

FIGS. 5*a-c* show a schematic diagram with a side view of reeds 100 according to the invention. In FIG. 5*a*, the reed back 111 is formed in the area of the clamping section 110 along the longitudinal direction 103 of the reed 100 in parallel or even exactly in parallel to the support wall 104 of the reed 100. In FIG. 5*b*, the reed back 111 is formed in the area of the clamping section 110 along the longitudinal direction 103 of the reed 100 at an angle α with respect to the support wall 104 of the reed 100, so that the clamping section 110 becomes thinner starting from the vibrating section 120 towards the rear edge 106. In FIG. 5*c*, the reed back 111 is formed in the area of the clamping section 110 along the longitudinal direction 103 of the reed 100 at an angle α with respect to the support wall 104 of the reed 100, so that the clamping section 110 becomes thicker starting from the vibrating section 120 towards rear edge 106. Deviating profiles of the reed back 111 along the longitudinal direction 103 with projections or depressions (not shown) are also encompassed in the inventive idea. It is essential that each or substantially each cross section of the clamping section along the longitudinal axis 103 is formed with symmetry in relation to an axis of symmetry 116 which is perpendicular to the support wall 104.

LIST OF REFERENCE NUMERALS 100 reed, especially precision reed
101 leading edge
102 side walls
103 longitudinal axis, central axis, axis of symmetry
104 support wall
105 reed from the prior art, reed blank
106 rear edge
110 clamping section
111 reed back
112 unevenness
113 bark, especially reed bark
114 convex curvature
115 dehumidifying groove
116 axis of symmetry of the cross section
120 vibrating section
121 taper, especially cutout
122 flank
123 heart
124 reed tip
200 mouthpiece
201 support surface, in particular the table of the mouthpiece
202 compressive force, contact pressure
A-A section line
α angle

The invention claimed is:

1. A reed (100) for reed instruments such as the clarinet or saxophone, made of wood or an Arundo donax section, having (a) a vibrating section (120), formed for sound generating by means of an air flow in the reed instrument;

(b) a clamping section (110) formed for engaging a reed holder for clamping the reed (100) to a mouthpiece (200) by the reed holder, the clamping section (110) having (i) a support wall (104) for supporting the reed (100) on the mouthpiece (200); and (ii) a reed back (111) opposite or facing away from the support wall (104);

characterized in that (c) the clamping section (110) includes a portion having a cross sectional configuration that is symmetrical to an axis of symmetry (116) which is perpendicular to the support wall (104) and extends along a longitudinal, central axis of symmetry (103); and (d) the reed back is configured to make uniform contact with the reed holder so that a uniform surface pressure is applied by the reed holder between the support wall (104) of the reed (100) and a support surface (201) of the mouthpiece.

2. The reed (100) according to claim 1, characterized in that the reed back (111) is, in the longitudinal direction (103), parallel to the support wall (104).

3. The reed (100) according to claim 1, characterized in that the reed back (111) is a wall of the clamping section (110) and has a convex curvature (114).

4. The reed (100) according to claim 1, characterized in that the reed (100) is Arundo donax.

5. The reed (100) according to claim 4, characterized in that reed bark (113) is completely removed from the back of the precision reed (100).

6. A method for producing a reed (100) for reed instruments, the method comprising:

(a) providing a reed blank (105) made of wood or an Arundo donax section;

(b) forming a support wall (104) for supporting the reed (100) on the mouthpiece (200);

(c) generating a vibrating section (120) by forming a cutout (121) or a taper;

(d) generating a clamping section (110) by machining a reed back (111) to form a portion of the clamping section (110) with a cross section configuration that is symmetrical about an axis of symmetry (116) which is perpendicular to the support wall (104) and forming the reed back (111) for uniform contact between the reed back (111) and a reed holder.

7. The method according to claim 6, characterized in that, the reed back (111) is formed, in a longitudinal direction (103), parallel to the support wall (104) by machining the reed back (111).

8. The method according to claim 7, characterized in that the reed back (111) is formed by machining the back (111) to a uniform or smooth surface.

9. The method according to claim 6, characterized in that reed bark (113) is completely or partially removed when forming the reed back (111).

10. The method according to claim 6, characterized in that the reed (100) is produced by (a) providing a reed blank (105) made of wood or an Arundo donax section, the reed blank (105) having at least one unmachined or natural surface with a reed bark (113), (b) forming the reed back (111) of the precision reed (100) by at least partially removing reed bark (113).

11. The method according to claim 10, characterized in that the reed (100) is obtained by forming the reed back (111) by completely removing reed bark (113).

* * * * *